US005144757A

United States Patent [19]

Sasso

[11] Patent Number: 5,144,757

[45] Date of Patent: Sep. 8, 1992

[54] HAIR DRYER WITH SPIRAL BLOWER

[75] Inventor: Pasquale Sasso, Saronno, Italy

[73] Assignee: Elite S.r.l., Senago, Italy

[21] Appl. No.: 621,962

[22] Filed: Dec. 4, 1990

[51] Int. Cl.[5] ..... F26B 21/00; A45D 20/00

[52] U.S. Cl. ..... 34/97; 34/96; 392/380; 392/381

[58] Field of Search ..... 34/96, 97, 90, 91; 416/223 R; 392/360, 363, 379, 380, 381

[56] References Cited

U.S. PATENT DOCUMENTS

| | | | |
|---|---|---|---|
| 1,872,483 | 8/1932 | Meyer | 34/97 |
| 3,006,078 | 10/1961 | Parker, Jr. et al. | 34/90 |
| 3,397,463 | 8/1968 | Laing | 34/97 |
| 3,807,495 | 4/1974 | Skarecky | 34/97 |
| 4,090,061 | 5/1978 | Glucksman | 34/97 |
| 4,109,138 | 8/1978 | Ohnmacht | 34/97 |
| 4,422,464 | 12/1983 | Josefsson | 34/78 |
| 4,471,213 | 9/1984 | Yoshida | 34/97 |
| 4,514,618 | 4/1985 | Majthan et al. | 34/97 |
| 4,735,002 | 4/1988 | Rath | 34/97 |

*Primary Examiner*—Henry A. Bennet
*Assistant Examiner*—Denise L. F. Gromada
*Attorney, Agent, or Firm*—Fleit, Jacobson, Cohn, Price, Holman & Stern

[57] ABSTRACT

A hair drying apparatus comprises a blower with a scroll internally provided with a fan having radial blades with flat lower edges and upper edges shaped to adapt to the scroll so as to define a substantially spiral path. Disposed below the scroll is an open external air inlet chamber containing the lower part of a motor which drives the fan so that said motor is cooled by the air in transit from the outside. The chamber substantially constitutes an extension of the spiral path in the scroll to which it is connected through a vertical aperture above which is disposed a horizontal baffle substantially flush with the lower edges of the blades of the fan.

13 Claims, 6 Drawing Sheets 31
30
32
α
V
26
27
24
38
39
21
23
25
IV
III
19
11
34
V

HAIR DRYER WITH SPIRAL BLOWER

This invention refers to a hot air blowing hair dryer, preferably of the wall-mounted type.

The general scope of this invention is to provide a hair drying apparatus having a blower with a relatively high output, actuated by a silent-running low-powered motor.

This scope is achieved, according to the invention, by providing a hair drying apparatus having an air blower, in particular for heated air, of the type having a scroll, internally provided with a fan having radial blades with flat lower edges and shaped on the upper part to adapt to the scroll, keyed onto the shaft of an electric motor, defining a spiral path with a substantially radial initial air inlet aperture below the scroll and a final air outlet aperture from a tangential extension duct of the scroll and containing electric heating elements, characterized by the fact that disposed below the scroll is a chamber with a circumferential wall with an air inlet aperture, constituting a substantial extension of the spiral path inside the scroll, said motor protruding centrally into said chamber so as to be lapped by the air moving in a substantially circular direction from said air inlet aperture to the aperture leading into the scroll.

The innovatory principles of this invention and its advantages with respect to the known technique will be more clearly evident from the following description of a possible exemplificative embodiment applying such principles, with reference to the accompanying drawings, in which.

Figure 1:
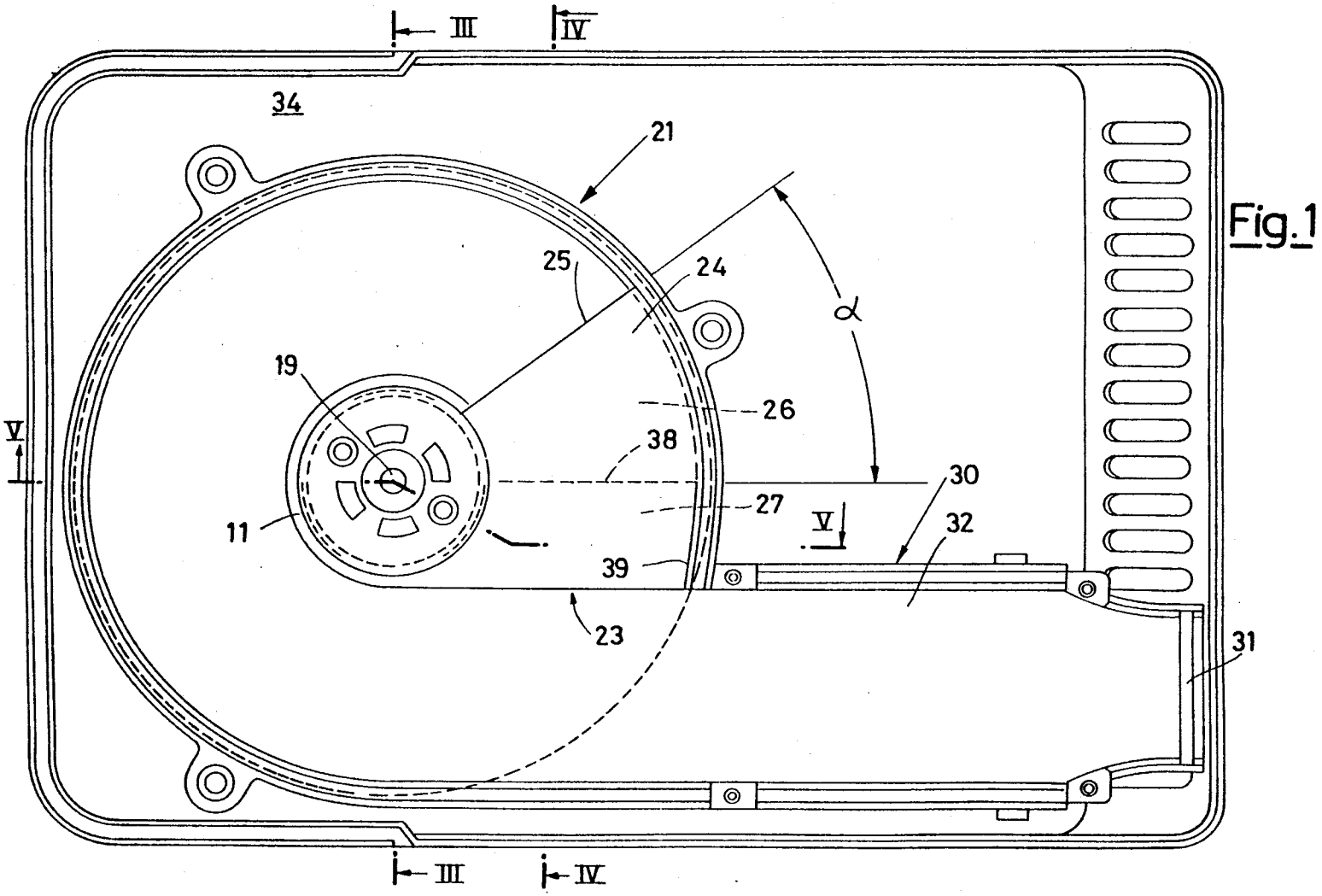
FIG. 1 shows a plan view of the lower half of a device according to the invention.

With reference to the figures, a hair dryer, advantageously wall-mountable, comprises a blower with a scroll 10 having a central protuberance 11 onto which an impeller 12 (for example, made of lightweight plastic) is rotatingly fitted by means of its central cup 13 with its lower edge connected to the internal wall of the scroll and carrying radial blades 14 provided from above with a supporting disk 15 with a raised edge 16 which fits slidingly into a circumferential groove 17 in the upper internal wall of the scroll.

The lower part of the protuberance 11 forms a housing with tabs 37 for an electric motor 18, the impeller 12 being keyed onto the shaft 19 of said motor by means of a bushing 20.

Figure 3:
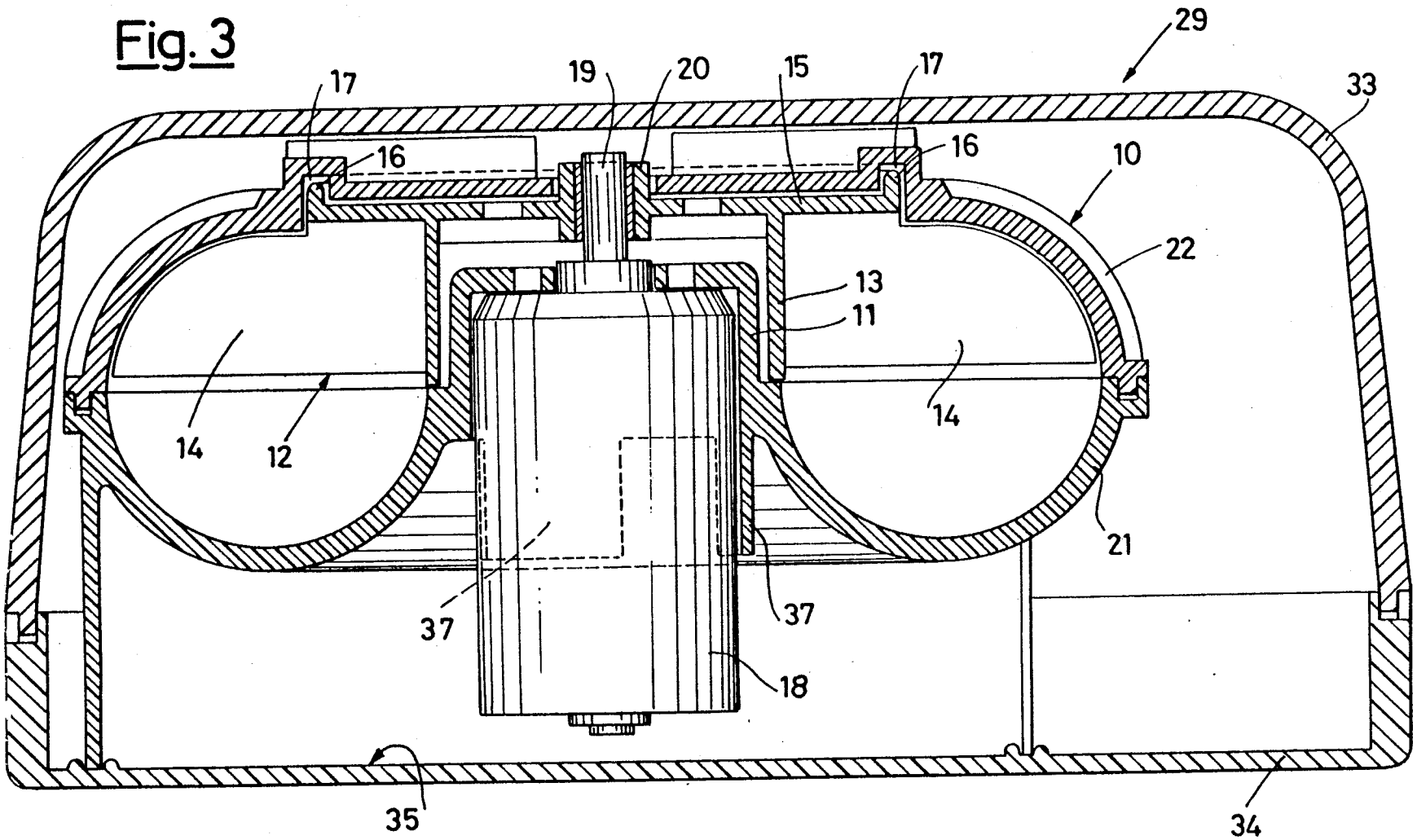
FIG. 3 shows a partial cross-sectional view along the line III—III of FIG. 1 of the assembled device.
Figure 4:
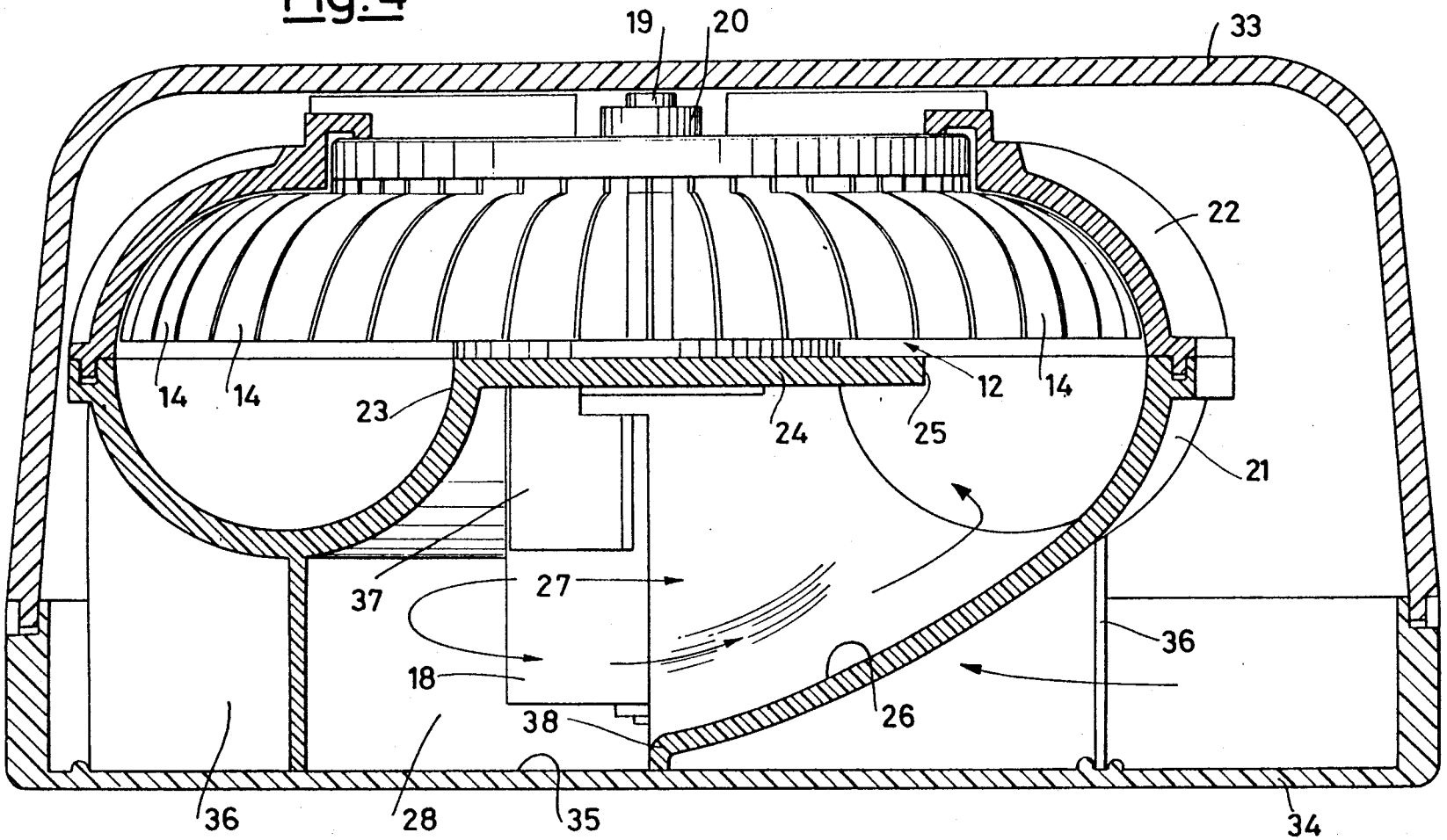
FIG. 4 shows a partial cross-sectional view along the line IV—IV of FIG. 1 of the assembled device.
Figure 5:
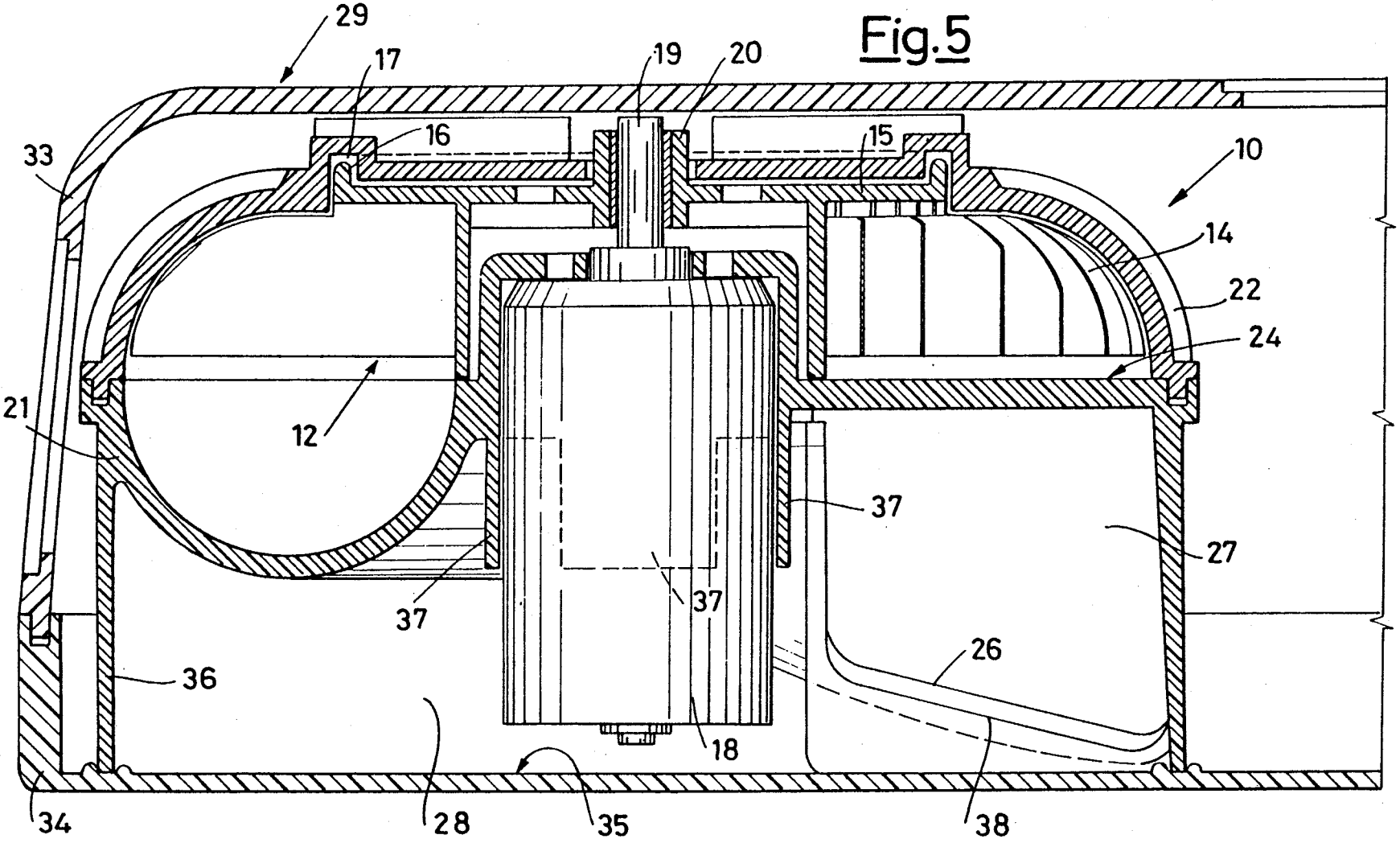
FIG. 5 shows a partial cross-sectional view along the line V—V of FIG. 1 of the assembled device.

As can be clearly seen in FIGS. 3, 4 and 5, the blades of the impeller are shaped to adapt to the curvature of the upper half of the scroll and have a flat lower edge so as to define a lower path around the protuberance 11.

Figure 6:
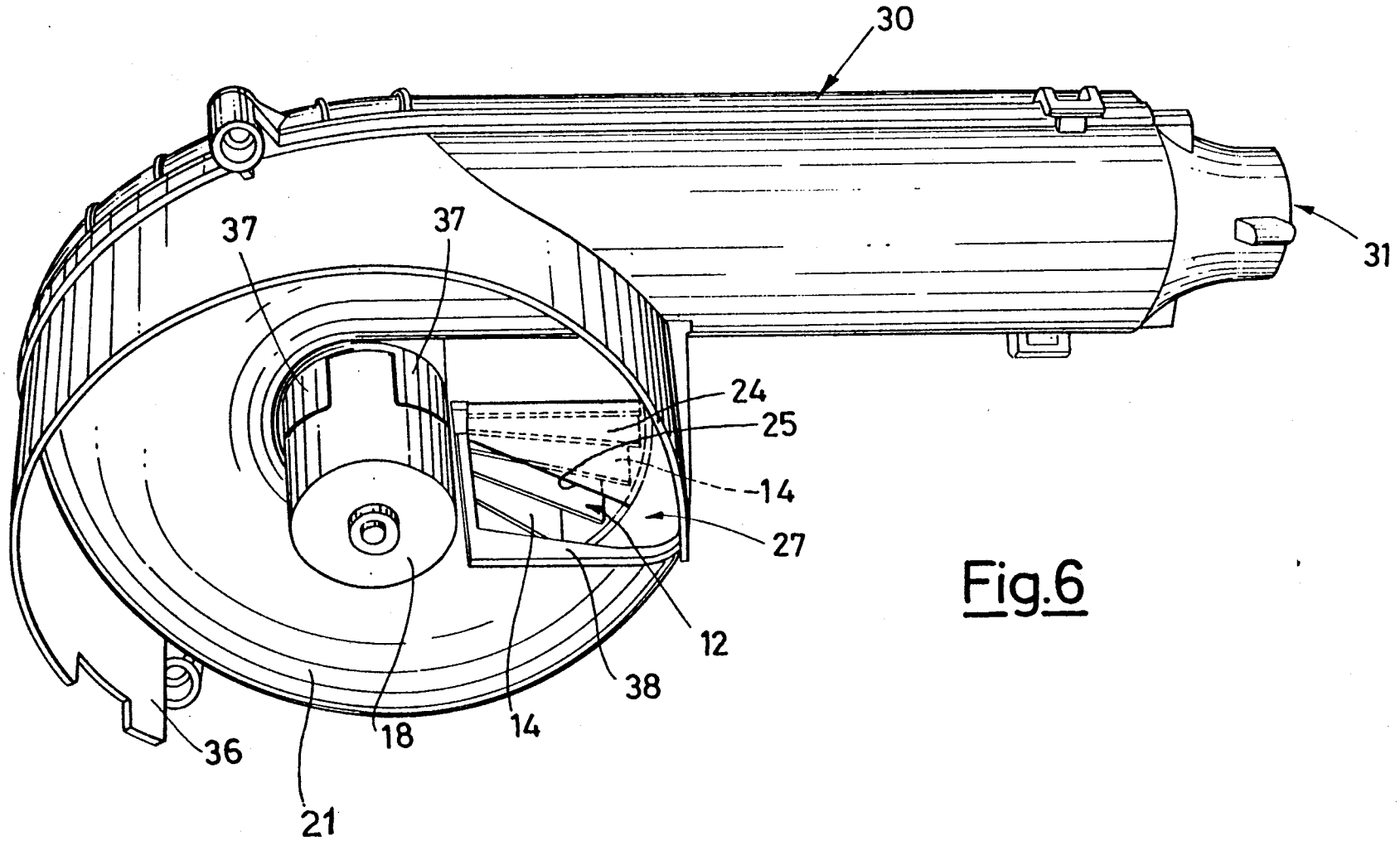
FIG. 6 shows a perspective bottom view of part of the device.

As can also be seen in FIG. 6, the scroll extends tangentially into a straight duct 30 with an open end 31.

Figure 2:
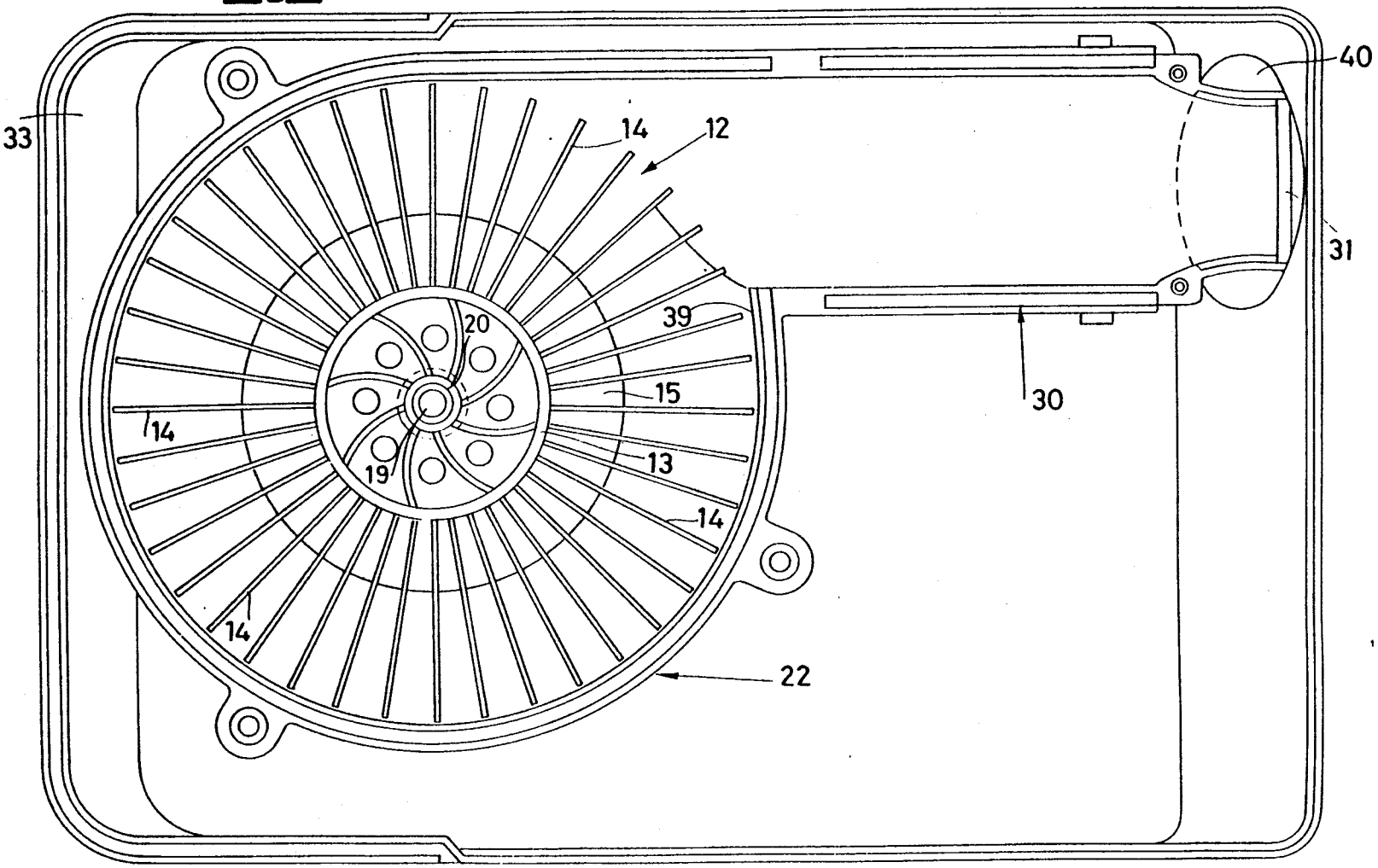
FIG. 2 shows a bottom view of the upper half of the device of FIG. 1.

In FIGS. 1 and 2, the blower is shown divided into two component halves, the lower half 21 and the upper half 22 respectively, with complementary edges shaped to enable them to fit substantially tightly together.

As can be seen in FIG. 1, the lower part 21 has its half 32 of the duct 30 also extending inside the scroll by one wall 23, to connect it to the central protuberance 11. The upper edge of the wall 23 extends into a horizontal baffle 24 substantially flush with the lower edges of the blades and with its edge 25 disposed at an angle with respect to the radial direction of the latter.

As shown in FIGS. 1 and 2, one area 39 (and, correspondingly, the complementary area 39') of lateral wall inside the scroll at the beginning of the spiral duct, namely close to the point of connection between the latter and the duct 30, has an increasing diameter so as to enable the lateral ends of the blades to come gradually closer to the lateral surface of the scroll in that area during rotation, after they have crossed the part which opens out onto the duct 30.

The circumferential path around the protuberance 11 continues spiral fashion thanks to a sloping portion 26 (as can be clearly seen in FIG. 4) until it reaches a vertical aperture defined from above by the baffle 24 and from below by a terminal edge 38 of the sloping surface 26, thus defining, beneath the baffle 24, a communicating duct between the inside of the scroll and its outer lower portion which, as can be clearly seen in FIG. 6, has an open circumferential wall 36. Said wall 36 extends from the inlet 27 to a position beyond the diametrically opposite position, thus constituting, together with the bottom wall 35 (as can be seen, for example, in FIG. 5), a laterally open chamber 28, into which protrudes the rear portion of the motor 18, and forming an extension of the internal spiral path of the scroll.

The angle $\alpha$, formed between the edge 25 of the baffle 24 and the vertical fronted aperture 27, is advantageously approximately 40°.

The bottom wall 35 can advantageously be the bottom of a container 29 (composed of two half shells 33 and 34, for example moulded from plastic) which houses the blower together with the connections and electrical components (of known technique and therefore not shown) required to operate it, such as switches, thermostats, etc., to form the complete hair dryer.

This container is provided with air inlet passages, exemplified by reference 39, and a passage 40 in correspondence with the end 31 of the tangential duct 30 in order to provide the latter with means (of known technique and therefore not shown) for distributing the flow of outcoming air.

When in operation, the fan rotates in an anticlockwise direction (as shown from above in FIG. 1) and the aspirated air consequently follows the path indicated by arrows in FIG. 4, entering the chamber 28, through the gap in the wall 36, with a rotatory movement, lapping the motor casing and then flowing into the casing of the scroll through the aperture 34 and then along the duct delimited by the baffle 24 and by the sloping surface 26.

After having passed through the spiral section inside the scroll, the air then flows out of the open end of the tangential duct.

Typically, a heating element will be provided inside the tangential duct for heating the air in transit (not shown since it can be of any known type).

According to the invention, one important advantage, with respect to the known technique, is that by circulating through the chamber 28 around the electric motor, the air sucked in by the blower helps to efficiently cool the latter, thereby making it possible to use very small motors with high speeds of rotation (for example, over 5000 r.p.m.) to obtain relatively high flows of outcoming air.

The flow of air entering the scroll, through the aperture 27, already moves in a spiral direction, coming from the chamber 28, and the duct formed by the baffle 24 and the portion 26 accelerates it before it comes into contact with the blades, thus improving the efficiency of the blower, thanks to the air which reaches the blades already at high speed, and reducing the turbulence, resulting in a reduction in the noise produced.

The fact that the edge 25 is not disposed radially and, consequently, that the blades of the fan always cut across it in an oblique position (at an angle found by trial-and-error to be advantageously ranging from 20° to 60°) prevents troublesome whistling when the blower is in operation even at said high speeds of rotation, just as other possible sources of whistling are prevented thanks to the gradual convergence of the lateral portion of the blades and the lateral internal surface of the scroll due to the substantially rectilinear-shaped portions 39.

It has also been found advantageous, for the efficiency of the blower, for the number of blades to be higher than 20, preferably higher than 30, for example, 40.

I claim:

1. A hair drying apparatus having an air blower of the type having a scroll, internally provided with a fan having a rotation axis and radial blades with flat lower edges shaped on the upper part to adapt to the scroll, the fan being keyed onto the shaft of an electric motor, the scroll defining a spiral path with a substantially radial initial air inlet aperture below the scroll and a final air outlet aperture leading into a tangential extension duct containing electric heating elements, the initial air inlet aperture opening from a chamber disposed below the scroll having a circumferential wall with an air inlet opening, said motor protruding centrally into said chamber so as to be lapped by air moving from said air inlet opening to the initial air inlet aperture, characterized in that the initial air inlet aperture is disposed on a plane substantially parallel to the fan rotation axis, and is connected to the inside of the scroll by an air flow passage having an inclined surface constituting a substantial extension of said spiral path of the scroll.

2. Apparatus as claimed in claim 1, characterized by the fact that the blades are higher than 20 in number.

3. Apparatus as claimed in claim 1, characterized by the fact that the blower is composed of two half-shells moulded from plastic and joined together by substantially airtight shaped edges.

4. Apparatus as claimed in claim 1, characterized by the fact that the chamber beneath the scroll has an inserted bottom.

5. Apparatus as claimed in claim 4, characterized by the fact that said inserted bottom is formed by the bearing wall of the scroll inside the apparatus.

6. Apparatus as claimed in claim 2 wherein the blades are higher in number than 30.

7. Apparatus as claimed in claim 6, wherein the blades are 40 in number.

8. A hair drying apparatus having an air blower, of the type having a scroll, internally provided with a fan with radial blades with flat lower edges and shaped on the upper part to adapt to the scroll, keyed onto the shaft of an electric motor, defining a spiral path with a substantially radial initial air inlet aperture below the scroll and a final air outlet aperture from a tangential extension duct of the scroll and containing electric heating elements, characterized by the fact that disposed below the scroll is a chamber with a circumferential wall with an air inlet opening, constituting a substantial extension of the spiral path inside the scroll, said motor protruding centrally into said chamber so as to be lapped by the air moving in a substantially circular direction from said air inlet opening to the initial air inlet aperture leading into the scroll, characterized by the fact that the initial aperture is delimited from above by a baffle disposed on the plane close to the lower edge of the blades of the fan and with its leading edge slanting with respect to the radial direction, so as to be crossed by the blades at a skew.

9. Apparatus as claimed in claim 8, characterized by the fact that the slant of the baffle ranges substantially from 20° to 60°.

10. Apparatus as claimed in claim 8, characterized by the fact that the angle between the leading edge of the baffle and the initial aperture ranges from 30° to 50°.

11. Apparatus as claimed in claim 8, characterized by the fact that the baffle and the surface of the spiral path beneath it constitute a tapered duct between the lower chamber and the inside of the scroll.

12. Apparatus as claimed in claim 10, wherein said angle is about 40°.

13. A hair drying apparatus having an air blower, of the type having a scroll, internally provided with a fan with radial blades with flat lower edges and shaped on the upper part to adapt to the scroll, keyed onto the shaft of an electric motor, defining a spiral path with a substantially radial initial air inlet aperture below the scroll and a final air outlet aperture from a tangential extension duct of the scroll and containing electric heating elements, characterized by the fact that disposed below the scroll is a chamber with a circumferential wall with an air inlet opening, constituting a substantial extension of the spiral path inside the scroll, said motor protruding centrally into said chamber so as to be lapped by the air moving in a substantially circular direction from said air inlet opening to the initial air inlet aperture leading into the scroll, characterized by the fact that the internal peripheral wall of the scroll is substantially tapered in the initial area of the spiral duct so as to constitute, on rotation of the fan, a surface with which the lateral ends of the blades gradually converge after they have crossed the portion of the scroll which opens out onto the tangential duct.

* * * * *